US009433958B2

(12) United States Patent
Kim

(10) Patent No.: US 9,433,958 B2
(45) Date of Patent: Sep. 6, 2016

(54) SAVER BOTTLE

(71) Applicant: Nam Joon Kim, Annandale, VA (US)

(72) Inventor: Nam Joon Kim, Annandale, VA (US)

( * ) Notice: Subject to any disclaimer, the term of this patent is extended or adjusted under 35 U.S.C. 154(b) by 4 days.

(21) Appl. No.: 14/444,639

(22) Filed: Jul. 28, 2014

(65) Prior Publication Data

US 2016/0022096 A1 Jan. 28, 2016

(51) Int. Cl.

| | |
|---|---|
| ***B05B 11/00*** | (2006.01) |
| ***B05B 15/00*** | (2006.01) |
| ***B65D 88/54*** | (2006.01) |
| ***A47K 5/12*** | (2006.01) |

(52) U.S. Cl.

CPC ..... *B05B 11/0037* (2013.01); *A47K 5/1205* (2013.01); *B05B 15/005* (2013.01); *B05B 11/30* (2013.01); *B05B 11/3042* (2013.01); *B05B 11/3047* (2013.01)

(58) Field of Classification Search

CPC . B05B 11/3042; B05B 11/30; B05B 15/005; B05B 11/0037; B05B 11/3047; A47K 5/1205
See application file for complete search history.

(56) References Cited

U.S. PATENT DOCUMENTS

| | | | | |
|---|---|---|---|---|
| 1,783,419 | A * | 12/1930 | Fitch | B65D 47/2031 222/309 |
| 2,613,988 | A * | 10/1952 | Jarbeau | B65D 77/283 215/388 |
| D252,372 | S | 7/1979 | MaCaulay | |
| 4,470,526 | A * | 9/1984 | Cha | B67D 1/0456 222/320 |
| 4,767,015 | A * | 8/1988 | Ho | A47G 19/2261 215/372 |
| 5,366,119 | A | 11/1994 | Kline | |
| 5,645,183 | A * | 7/1997 | Slat | B29C 49/0073 215/12.1 |
| D523,587 | S | 6/2006 | Gill | |
| D541,088 | S | 4/2007 | Nesci | |
| 7,757,899 | B2 * | 7/2010 | van der Heijden | B05B 11/3087 222/1 |
| 8,025,169 | B2 * | 9/2011 | Zimmerman | A47G 19/2261 220/23.86 |
| D687,965 | S | 8/2013 | Trump | |
| 8,763,825 | B2 * | 7/2014 | Wauters | B65D 1/16 206/503 |
| 8,925,767 | B2 * | 1/2015 | Iizuka | B65D 1/0261 220/608 |
| 2003/0132185 | A1 * | 7/2003 | Beaudette | A61J 9/006 215/11.4 |
| 2006/0186144 | A1 * | 8/2006 | Tinsley | B05B 11/0037 222/377 |
| 2007/0181605 | A1 | 8/2007 | Yang | |
| 2009/0008414 | A1 * | 1/2009 | Tingsley | B05B 11/0037 222/377 |
| 2009/0095701 | A1 * | 4/2009 | Forsthovel | B65D 1/0207 215/329 |
| 2010/0301640 | A1 * | 12/2010 | Heiser | A47C 1/06 297/135 |

(Continued)

FOREIGN PATENT DOCUMENTS

WO 2011/059407 A1 5/2011

*Primary Examiner* — Frederick C Nicolas
(74) *Attorney, Agent, or Firm* — Maier & Maier, PLLC

(57) ABSTRACT

The saver bottle is primarily intended to improve on existing bottle designs for storing and dispensing small quantities of fluid, such as liquid soap, shampoo, sunscreen, or similar fluids. The existing bottle designs used for these fluids are often unable to disgorge all of their liquid contents during normal use and leave some measure of their contents as a residue at the bottom of the bottle, which is wasteful and inefficient. The saver bottle is adapted to waste less of its liquid contents, and may include a sump, a sloped internal lower surface, a pumping mechanism accessible from the outside of the bottle, and a suction straw. The suction straw may terminate in a flared suction bell, and may extend into the sump. The sloped internal lower surface may be sized to maximize the internal volume of the bottle while still ensuring that any liquids the bottle is intended to house may freely drain into the sump at the bottom of the bottle.

15 Claims, 3 Drawing Sheets

(56) References Cited

U.S. PATENT DOCUMENTS

2011/0240678 A1* 10/2011 Keller ..... B05B 11/0037
222/321.5

2012/0132676 A1 5/2012 Rhodes

2013/0075407 A1* 3/2013 Day ..... B65D 83/0888
220/500

* cited by examiner

SAVER BOTTLE

BACKGROUND

Many liquid consumer products, like many forms of liquid soap, shampoo, sunscreen, hand sanitizer, and hand lotion, are sold pre-packaged in bottles with dispenser pumps. Such pumps allow users to dispense small and generally consistent amounts of liquid from the bottle without pouring from it or inverting it, which generally eases access to the contents of the bottle and reduces cross-contamination of the contents by other users.

Many dispenser pump configurations, however, are deficient in that they do not allow for the entirety of the liquid contents of the bottle to be dispensed. Many such pumps draw from a suction straw that terminates at some level above the lower surface of the bottle in which they are mounted, and cease to be able to draw liquid once the lower end of the suction straw is uncovered. As a result, these pump configurations often leave an unused residue of liquid between where the suction straw terminates and the lower surface of the bottle. The amount of liquid wasted in the manner, as a percentage of contents in the bottle, is often quite high.

There is a need for an improved bottle design that, when coupled with an appropriate pump design, better utilizes the liquid in the bottle and reduces the amount of liquid left as unused residue. Current designs are less efficient in the amount of liquid they can remove, spatially inefficient, or are more complex or costly to manufacture.

SUMMARY

According to one exemplary embodiment, a new and improved bottle primarily intended for the purpose of storing and dispensing small quantities of fluid may be described. This bottle may include a sump, an internal lower surface, a pumping mechanism accessible from the outside of the bottle, and a suction straw. The suction straw may terminate in a flared suction bell, and may extend into the sump. The internal lower surface may be sloped and may be sized to maximize the internal volume of the bottle while still ensuring that any liquids the bottle is intended to house may freely drain into the sump at the bottom of the bottle.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
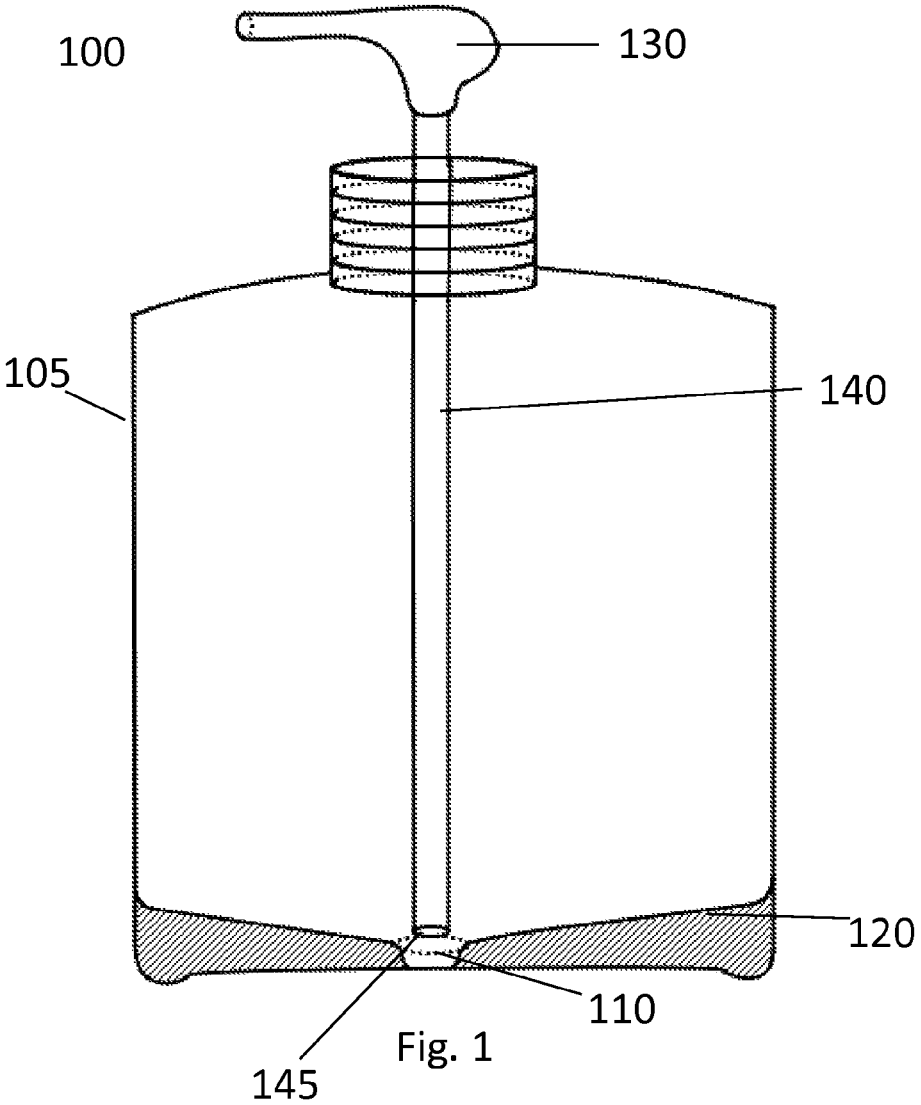
FIG. 1 is a cross-sectional view of an exemplary embodiment of a saver bottle, having an elliptically cylindrical design.
Figure 2:
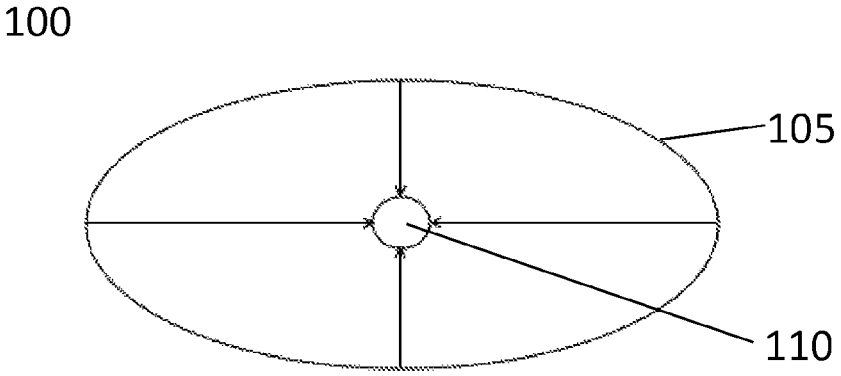
FIG. 2 is a bottom plan view of the saver bottle of FIG. 1.
Figure 3:
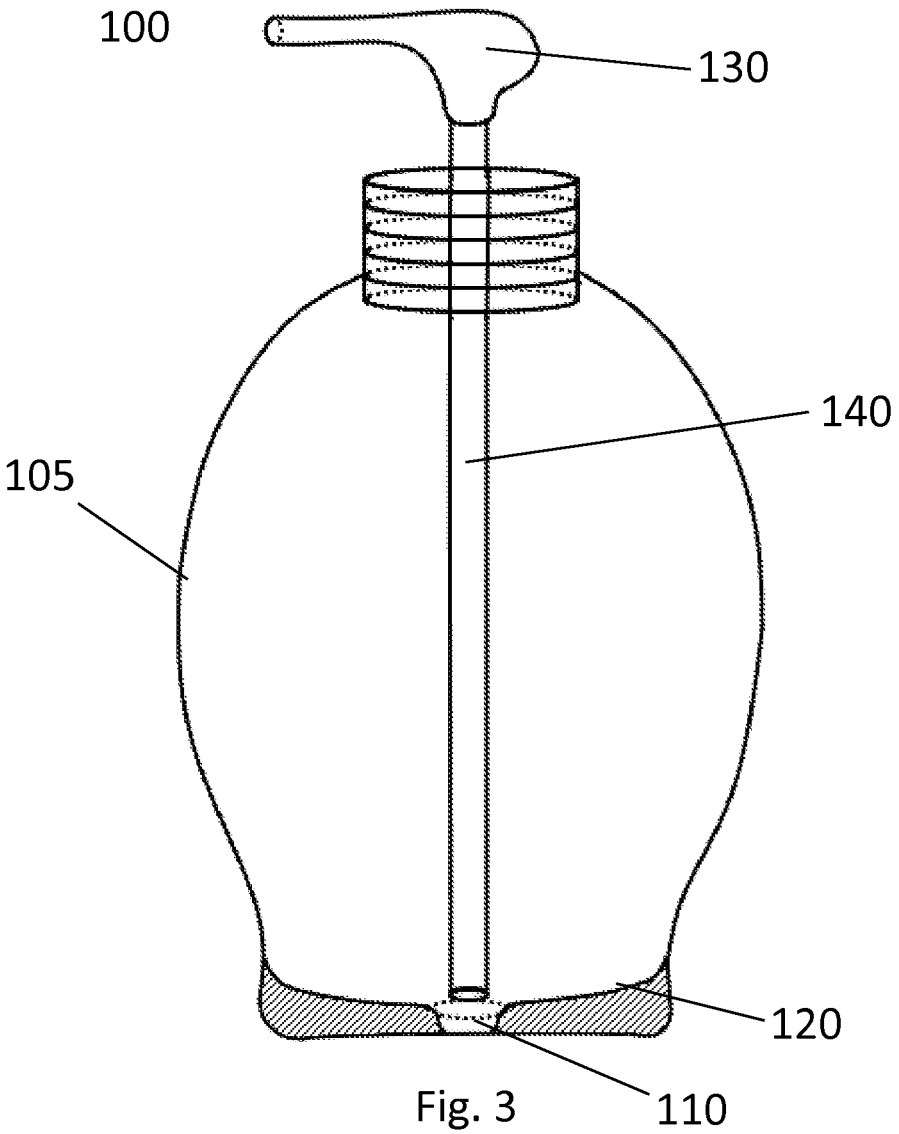
FIG. 3 is a cross-sectional view of an exemplary embodiment of a saver bottle, having an ovoid design.

Referring generally to FIGS. 1-3, a new and improved bottle primarily intended for the purpose of storing and dispensing small quantities of fluid as generally represented by reference numeral 100 (hereinafter a "saver bottle") may be described. According to the exemplary embodiment shown in FIG. 1, an upright, free-standing saver bottle 100 may have a bottle sidewall 105 shaped as depicted and with at least one layer, and may have a sump 110, an internal lower surface 120, a pumping mechanism accessible from the outside of the bottle 130, and a suction straw 140. The pumping mechanism 130 may be removably mounted to the bottle sidewall 105 or may be fused with it or a portion of it, and may optionally aerate the liquid that it dispenses. The suction straw 140 may have a semirigid cylindrical design and a flattened terminus 145. According to other embodiments, the suction straw may instead be formed into another shape (for example, it may twist inside the bottle or have a hexagonal cross-section), and may be flexible or rigid.

The terminus 145 of the suction straw 140 may instead be cut at an angle, may be notched or grooved, or may have another shape as appropriate. Furthermore, the terminus 145 of the suction straw 140 may have a geometry distinguishable from that of the remainder of the suction straw 140; for example, the terminus 145 may be flared to reduce minor losses in the pump mechanism and improve suction (a "suction bell" design), or may be sized to readily fit within the sump 110. The terminus 145 of the suction straw 140 may be located directly above the sump 110, partially or wholly within it, or at another desirable location. According to another embodiment, the suction straw 140 may fork and have multiple termini 145; alternatively, a plurality of suction straws 140 may be used. Such a configuration may be used, for example, to mix a plurality of fluids from a plurality of internal chambers before the combination is dispensed from the nozzle of the pumping mechanism 130.

Referring now to FIG. 2, the saver bottle 100 may have an elliptical bottle sidewall 105 and a centrally-located circular sump 110. The bottom of the bottle may be smooth and flat as depicted in FIG. 2, may have a number of downward-facing protrusions such as downward-facing "legs" or "feet" intended to reduce the contact area the bottom of the bottle has with the surface the bottle is located on, may have adhesive pads or another anti-slip mechanism added to better ensure that the bottle remains in place when set upright, or may have other desirable geometry or features.

Referring to FIG. 3, the saver bottle 100 may instead have an ovoid bottle sidewall 105, or another desirable geometry. A different geometry for the shape of the bottle sidewall 105 may be selected based on, for example, the ease with which a certain design may be held in the hand or gripped or the packing efficiency that a certain shape demonstrates. For example, a shape with a bottleneck-like taper may be selected to make the bottle easier to grip, or a rectangular prism bottle design may be selected to make bottles pack together more easily when shipped. Alternatively, more minor variations of the geometry may be made to meet such ends; for example, the bottle sidewall 105 may be given an outer texture consisting of a plurality of raised dots or other raised surface features so as to improve grip, or a portion of one of the sides of the bottle sidewall 105 may be made concave in order to facilitate stacking of the saver bottles 100 on their sides (thereby improving packing efficiency). The bottle sidewall 105 may consist of one layer or a plurality of layers, with layers potentially being of differing compositions. For example, the outer layer of a bottle could be composed of glass, ceramic, or another decorative material, while an inner layer with a sump 110 and internal lower surface 120 could be made of clear plastic and serve as a liner for the bottle; optionally, such a bottle could be constructed such that the clear plastic inner layer could be readily removed and replaced without harm to the decorative bottle sidewall 105.

Again referring generally to FIGS. 1-3, the dimensions of the sump 110, shape and slope of the internal lower surface 120, and geometry of similar features may be selected based on, for example, the geometry of the bottle, the geometry of the suction straw 140 or its terminus 145, or the viscosity of the liquid to be dispensed. Certain dimensions may allow the pumping mechanism 130 and suction straw 140 to access a higher quantity of the contents of the bottle and thereby leave less residue, may maximize the internal volume of the bottle while still sloping inward to allow liquid to drain into the sump, or may be easier and less expensive to produce given a certain bottle geometry. For example, the embodiment shown in FIG. 1 shows a sloped internal lower surface 120 with a substantially flat and shallow grade that maximizes the internal volume of the bottle, while the embodiment shown in FIG. 3 shows a substantially concave internal lower surface 120 featuring a distinctly nonuniform slope that blends with the ovoid design of the bottle sidewall 105 and offers greater ease of manufacturing. In the preferred embodiment, that shown in FIG. 1, the diameter of the sump 110 is approximately ⅜ inch, the depth of the sump 110 is approximately ½ inch, and the slope of the internal lower surface is very small and substantially uniform, such that the pumping mechanism 130 may access approximately 99.9% of the liquid contents of the saver bottle 100. The efficiency of a saver bottle 100 may be defined as the percentage of the liquid contents that the pumping mechanism 130 is capable of accessing and ultimately dispensing; an embodiment in which the pumping mechanism 130 may access approximately 99.9% of the liquid contents of the saver bottle 100 may be considered to be 99.9% efficient.

Figure 4:
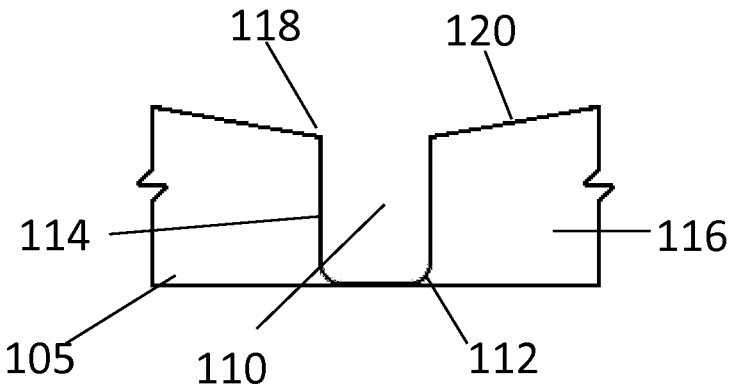
FIG. 4 is an enlarged view of the sump component of a dispenser bottle.

Referring now to FIG. 4, the sump 110 may have an internal fillet or chamfer 112 that connects the bottom portion of the sump 110 to the sump sidewalls 114, a surrounding fill 116, and an interface 118 between the sidewalls of the sump 114 and the internal lower surface 120. The bottom portion of the sump 110 may extend all the way to the lower surface of the outermost wall of the bottle 105, or may terminate at some distance above it and likewise be spaced with a filler. This space, and the surrounding fill 116, may be solidly filled with the same material that the bottle is made out of (such as plastic or a composite), may be hollow, or may be filled with another desirable material. The sidewalls of the sump 114 may be vertical, may be sloped, or may slope to a conical point such that there is no clearly defined bottom surface of the sump; alternatively, the sump 110 may be hemispherical. The interface between the sump sidewalls and the sloped portion 118 may likewise be rounded or chamfered, or may be angular.

Figure 5:
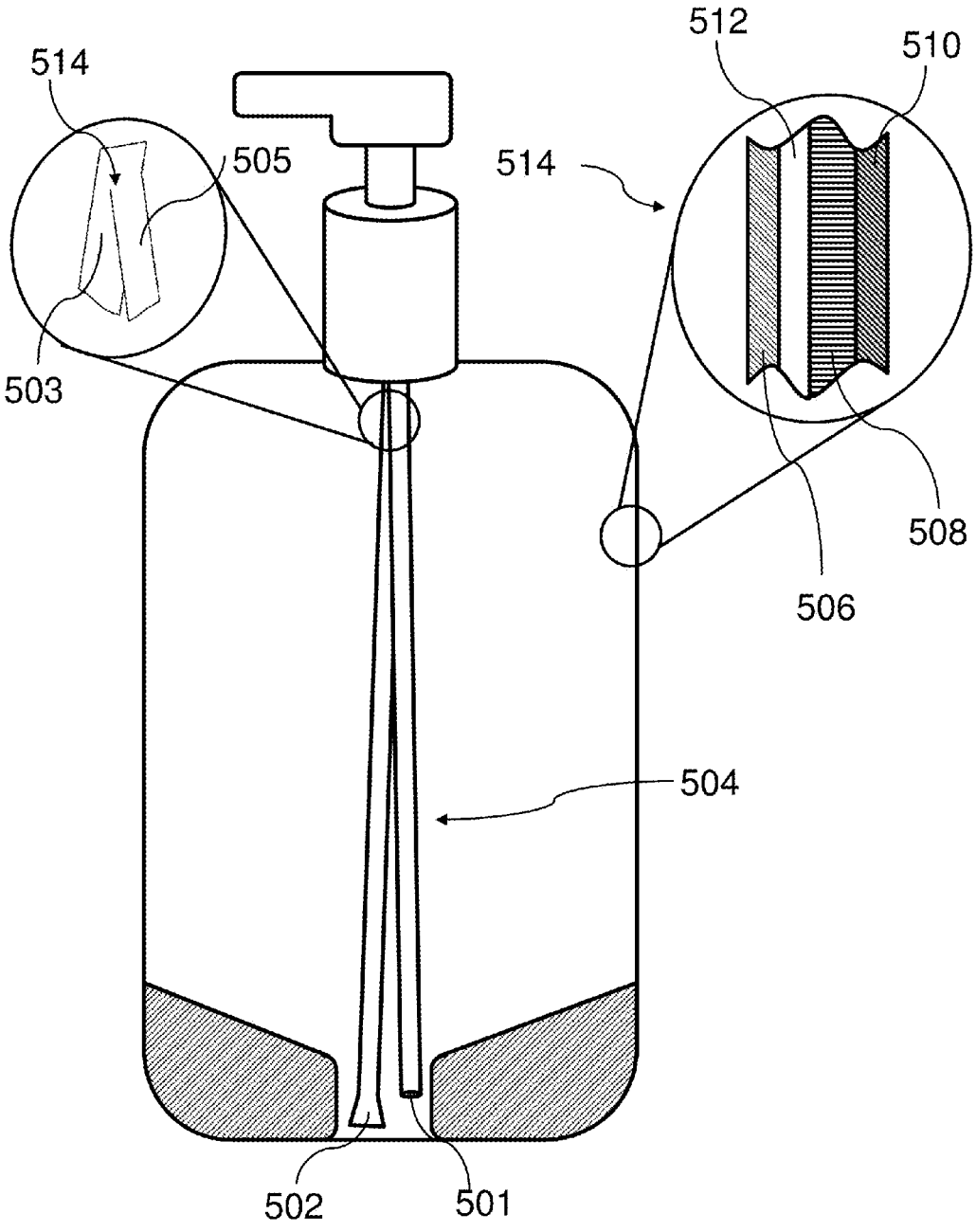
FIG. 5 is a cross-sectional view of an exemplary embodiment of a saver bottle.

In a further exemplary embodiment illustrated in FIG. 5, the terminus 502 may be flared to reduce minor losses in the pump mechanism and a plurality of suction straws 504 may be used. Still referring to FIG. 5, the bottle sidewall may comprise one layer or a plurality of layers 506, 508, 510, and 512 with layers 506, 508, 510, and 512 potentially being of differing compositions as illustrated by the cross section close up 514. Additionally, as shown in exemplary FIG. 5, first straw 503 (having flared terminus 502) and second straw 505 (having round terminus 501) may be utilized for suction, as described herein. Further, first straw 503 may join second straw 505 at junction 514. This can allow for the mixing of contents, for example liquids, collected as a result of suction from the first straw 503 and second straw 505 by action of the pumping mechanism. Additionally, first straw 503 and second straw 505 may have different heights or lengths so as to facilitate greater collection of contents and liquids from the sump.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A container for dispensing fluid, comprising:

a bottle having a generally flat exterior base, a bottle sidewall comprised of at least one layer, and an internal lower surface that is substantially and nonuniformly sloped, wherein the underside of the bottle has an anti-slip surface;

the bottle additionally having a sump formed in the approximate center of the internal lower surface of the bottle and substantially surrounded by sloped portions of the internal lower surface, wherein the sloped portions of the internal lower surface are inward-sloping and direct the content of the bottle into the sump, and wherein the diameter of the sump is at ⅜" and the depth of the sump is ½" and an area between the internal lower surface of the bottle and sloped portions of the internal lower surface is hollow;

the bottle additionally having a substantially rounded interface between the internal lower surface of the bottle and the sidewalls of the sump;

a pumping mechanism extending from the top of the bottle; and a pair of suction straws disposed in the sump, a first suction straw having a first length and a flared terminus, a second suction straw having a length shorter than the first section straw and a round terminus, the first suction straw and the second suction straw further joining at a point between the pump and the terminus of the first suction straw and the second suction straw to provide a mixing of contents drawn into the straws by action of the pump.

2. The apparatus of claim 1, wherein the bottle sidewall has an approximately elliptically cylindrical shape.

3. The apparatus of claim 1, wherein the bottle sidewall has an approximately ovoid shape.

4. The apparatus of claim 1, wherein the bottle sidewall has a bottleneck-like taper that reduces the outer diameter of the bottle between the lower portion below the bottleneck and the upper portion above the bottleneck.

5. The apparatus of claim 1, wherein the bottle sidewall has an approximately rectangular prismatic shape.

6. The apparatus of claim 1, wherein the terminus of the first suction straw and the second suction straw are sized to fit within the sump.

7. The apparatus of claim 1, wherein the underside of the bottle has a plurality of support legs located near the outer perimeter of the generally flat support base.

8. The apparatus of claim 1, wherein the internal lower surface of the bottle blends with the shape of the bottle sidewall.

9. The apparatus of claim 1, wherein the space between the internal lower surface of the bottle and the exterior base of the bottle is hollow.

10. The apparatus of claim 1, wherein the sidewalls of the sump are inward-sloping.

11. The apparatus of claim 1, wherein the sump is cylindrical.

12. The apparatus of claim 1, wherein the sump is hemispherical.

13. The apparatus of claim 1, wherein the bottle sidewall comprises a plurality of layers with different material compositions.

14. The apparatus of claim 1, wherein the bottle sidewall has at least one raised surface feature.

15. The apparatus of claim 1, wherein the internal lower surface of the bottle is substantially concave.

* * * * *